United States Patent [19]

Marinoni

[11] 4,422,213

[45] Dec. 27, 1983

[54] DOOR CLOSER SHAFT

[75] Inventor: Mario Marinoni, Magenta, Italy

[73] Assignee: Casma di Vi Marinoni & Figli, Maggio, Italy

[21] Appl. No.: 289,905

[22] Filed: Aug. 4, 1981

[30] Foreign Application Priority Data

Sep. 4, 1980 [DE] Fed. Rep. of Germany ..... 3033363

[51] Int. Cl.[3] ..... E05F 3/00

[52] U.S. Cl. ..... 16/71; 16/65; 16/80; 16/DIG. 10

[58] Field of Search ..... 16/50, 63–65, 16/71–81, DIG. 10, DIG. 17, DIG. 41; 411/340, 535; 285/4

[56] References Cited

U.S. PATENT DOCUMENTS 2,639,459 5/1953 Werner ..... 16/65
4,240,462 12/1980 Bankstahl ..... 285/4 X

FOREIGN PATENT DOCUMENTS 1175110 1/1960 Fed. Rep. of Germany ..... 16/77
2218498 5/1980 Fed. Rep. of Germany ..... 16/80
103133 11/1941 Sweden ..... 16/65

*Primary Examiner*—Fred Silverberg
*Attorney, Agent, or Firm*—Toren, McGeady and Stanger

[57] ABSTRACT

An axially extending closer shaft for a door closer is made up of an axially extending first section mounted in a door closer housing and an axially extending second section aligned with and connected to the first section and located outside of the housing. A plurality of annular grooves are formed in the second section extending perpendicularly of the shaft axis and spaced apart in the direction of the shaft axis. The second section can be cut to the desired length in the plane of one of the grooves. The first and second sections can be connected together by a plurality of bolts extending in the axial direction of the shaft or by a single shaft and coupling balls positioned within recesses in the first shaft and in bores in the second shaft.

6 Claims, 3 Drawing Figures

DOOR CLOSER SHAFT

SUMMARY OF THE INVENTION

The present invention relates to a door closer shaft with a section of the shaft mounted in the door closer housing where it is under the influence of a closing spring and a damper with a second section of the shaft located outside of the housing and connected to the first section of the shaft and to a door.

A door closer of this type is disclosed in West German Auslegeschrift No. 2 218 498. In such a door closer, though the second section of the closer shaft can be replaced, it can not be easily adapted to different installation conditions.

Therefore, the primary object of the present invention is to provide a door closer shaft which can be adapted to different installation conditions and is characterized by the provision of annular grooves formed in the second shaft section with the grooves extending transversely of the axial direction of the shaft and spaced apart in the axial direction.

In accordance with the present invention, the axial length of the second section can be varied by cutting the second section in the plane of one of the grooves. As a result, only a single type of the second section of the closer shaft needs to be produced. With such an arrangement, the fabrication costs and warehousing costs are reduced. It is only necessary for the manufacturer and the dealer to stock one type of the second shaft section of the door closer. Because of the plurality of spaced grooves in the second section the cutting of the second section to a desired length can be easily accomplished without any difficulty.

The first and second sections of the closer shafts can be coupled together in an especially simple manner so that the two sections turn as a unit by providing recesses in the end surface of the first section facing the second section for receiving coupling balls and with axially extending ducts formed in the second section arranged to be aligned with the recesses and to receive the balls.

Using such a ball coupling arrangement, the second section can be secured to the first section using a single bolt extending along the axis of the shaft. If two or more axially extending bolts are used, then the use of coupling balls for securing the shaft sections together is unnecessary.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

and

Figure 1:
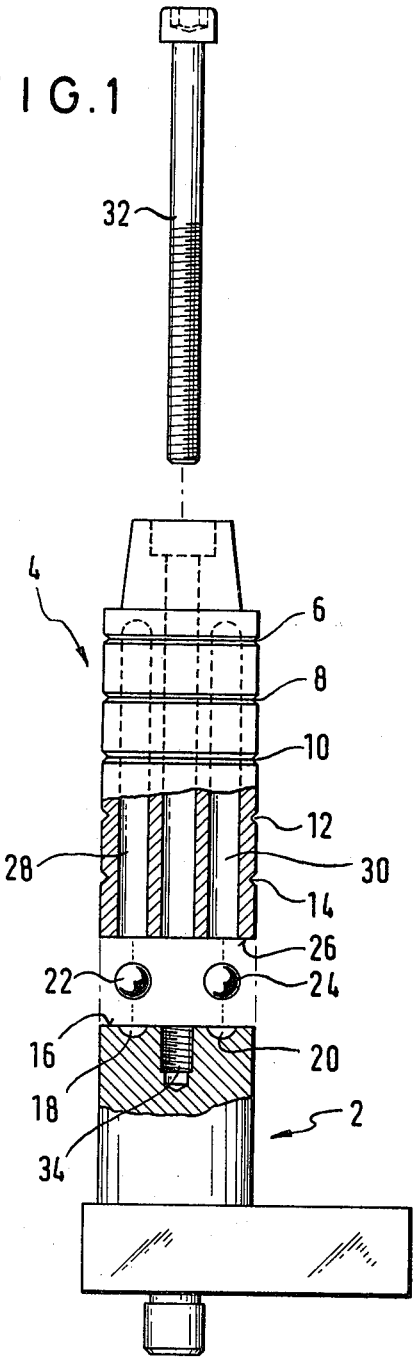
FIG. 1 is an elevational view, partly in section, of a closure shaft embodying the present invention and illustrated in an exploded manner.
Figure 3:
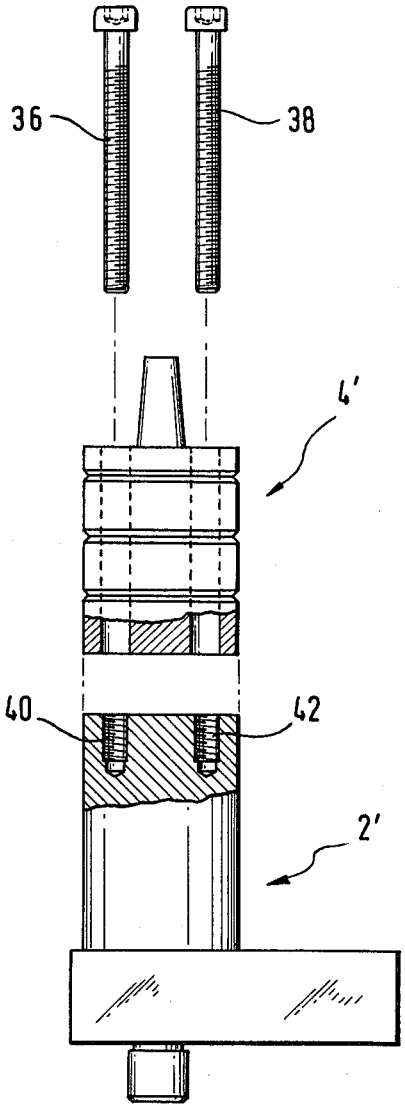

FIG. 3 is a view similar to FIG. 1, however, illustrating a second embodiment of the present invention.

DETAILED DESCRIPTION OF THE INVENTION

Figure 2:
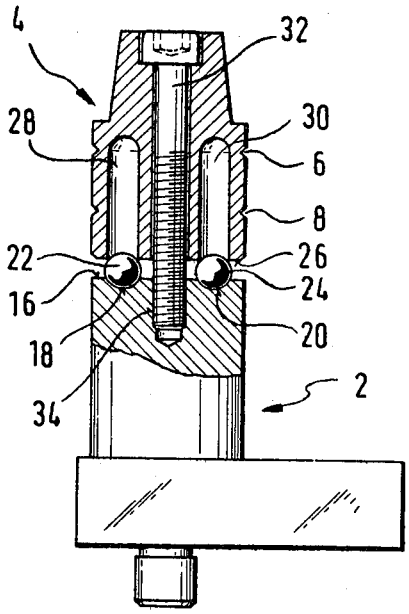
FIG. 2 is an elevational view, partly in section, of the closure shaft illustrated in FIG. 1 in the assembled condition.

In the embodiment illustrated in FIGS. 1 and 2, a closure shaft includes a first section 2 arranged to be mounted in a housing, not shown. Within the housing the first section 2 is under the influence of a closing spring and a damper, not shown. The closure shaft also includes a second section 4 arranged to be located outside the housing and to be connected with a door. Second section 4 is in axial alignment with the first section 2. Second section 4 includes a plurality of annular grooves 6, 8, 10, 12, 14 each running transversely of the axial direction of the closer shaft with the grooves being spaced apart in the axial direction. First section 2 of the closer shaft has an end surface 16 facing toward the adjacent end surface of the second section 4. The end surface 16 has a pair of recesses 18, 20 located on diametrical opposite sides of the shaft axis and shaped to receive coupling balls 22, 24. Axially extending bores 28, 30 are formed in the second section and extend from the end surface 26 of the second section facing the end surface 16 of the first section and in alignment with the recesses 18, 20. The bores 28, 30 extend through the second section for at least the length thereof from the end surface 26 to the most remote groove 6. Instead of two coupling balls as shown in FIGS. 1 and 2, depending on the number of angular adjustments desired for attaching the second section 4 to the first section 2, three or more coupling balls can be used with corresponding recesses formed in the end surface 16 of the first section 2 and corresponding ducts formed in the second section 4.

In the second section 4, another bore extends along the axis and is arranged to receive the bolt 32 for connecting the two sections of the closure shaft together. Bolt 32 extends through the bore in the second section 4 and is screwed tightly into the tapped blind bore 34 in the end surface 16 of the first section 2.

As compared to FIG. 1, it can be appreciated in FIG. 2 that the second section 4 has been reduced in axial length by cutting the section in the plane of the groove 10.

In the preferred embodiment, the annular grooves have a triangular cross-section. In the embodiment illustrated in FIG. 3, the sole difference over the embodiment in FIGS. 1 and 2 is that the second section 4' is connected to the first section 2' by a pair of axially extending bolts 36, 38 each extending into a tapped blind bore 40, 42 formed in the first section 2'. The bolts 36, 38 are spaced on opposite sides of the axis of the closer shaft. In this embodiment, the number of bolts 36, 38 can be increased so that the second section 4' can be connected to the first section 2' in a number of different angular positions.

While specific embodiments of the invention have been shown and described in detail to illustrate the application of the inventive principles, it will be understood that the invention may be embodied otherwise without departing from such principles.

I claim:

1. An axially extending closer shaft for a door closer comprises a first axially extending section arranged to be mounted in a door closer housing where it is under the influence of a closing spring and a damper, and a second axially extending section in alignment with said first section and connected to said first section, said second section arranged to be located outside the door closer housing and to be connected to a door, wherein the improvement comprises that said second section has a plurality of annular grooves extending around the axis thereof with said grooves spaced apart in the axial direction of the closer shaft, said first section has an end surface extending transversely of the axis of the closer shaft adjacent to the second section and said end surface having at least two recesses formed therein, a coupling ball located in each of said recesses, and said second section has an axially extending bore extending from the end surface of said second section adjacent the end surface of said first section and aligned with each one of said recesses in said first section so that said balls seat within said bores for providing a coupling between said first and second sections.

2. An axially extending closer shaft, as set forth in claim 1, wherein said axially extending bores in said second section for receiving the coupling balls extend from the end surface of said second section facing the end surface of said first section for at least the axial length of said second section to said annular groove formed therein most remote from said end surface.

3. An axially extending closer shaft, as set forth in claim 2, wherein said bores in said second section for receiving said coupling balls are blind bores.

4. An axially extending closer shaft, as set forth in claim 1, wherein the adjacent end surfaces of said first and second shafts extend normally of the axial direction of the closer shaft.

5. An axially extending close shaft, as set forth in claim 1, wherein said grooves in said second section each being located in a plane parallel with the end surface of said first section adjacent to the end surface of said second section.

6. An axially extending closer shaft, as set forth in claim 1, wherein said first section has at least one threaded blind bore therein, said second section has at least one bore therein aligned with the blind bore in said first section, and a threaded bolt positionable through the bore in said second section into the blind bore in said first section for connecting said first and second sections together.

* * * * *